US006109145A

United States Patent [19]

Habermehl

[11] Patent Number: 6,109,145

[45] **Date of Patent: *Aug. 29, 2000**

[54] POWER DRILL HOUSING EXTENSION COUPLING

[76] Inventor: G. Lyle Habermehl, 436 Calvert Dr., Gallatin, Tenn. 37066

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 09/091,816

[22] PCT Filed: Dec. 23, 1996

[86] PCT No.: PCT/CA96/00877

§ 371 Date: Jun. 22, 1998

§ 102(e) Date: Jun. 22, 1998

[87] PCT Pub. No.: WO97/24205

PCT Pub. Date: Jul. 10, 1997

Related U.S. Application Data

[63] Continuation of application No. 08/579,284, Dec. 27, 1995, Pat. No. 5,662,011.

[51] Int. Cl.[7] ..... B25B 23/06

[52] U.S. Cl. ..... 81/434; 81/57.37

[58] Field of Search ..... 81/57.33, 434, 81/435, 467, 472, 476

[56] References Cited

U.S. PATENT DOCUMENTS

| | | |
|---|---|---|
| 1,024,151 | 4/1912 | Smith . |
| 1,793,053 | 2/1931 | Cahill . |
| 2,621,685 | 12/1952 | Butz . |
| 2,631,619 | 3/1953 | Folli . |
| 2,696,940 | 12/1954 | Andresen . |
| 2,901,912 | 9/1959 | Digby . |
| 3,305,156 | 2/1967 | Khan . |
| 4,404,877 | 9/1983 | Mizuno et al. . |
| 4,478,112 | 10/1984 | Moulton . |
| 4,949,463 | 8/1990 | Chen . |
| 4,972,589 | 11/1990 | Povleski . |
| 5,144,870 | 9/1992 | Nick . |

FOREIGN PATENT DOCUMENTS

| | | |
|---|---|---|
| 0626239 | 11/1994 | European Pat. Off. . |
| 4325995 | 2/1995 | Germany . |
| 676812 | 3/1991 | Switzerland . |

*Primary Examiner*—James G. Smith
*Attorney, Agent, or Firm*—Dorsey & Whitney LLP

[57] ABSTRACT

A universal housing adapted to be coupled to the front of a wide variety of known drills having different sizes and configurations for securing the housing extension fixed to the housing. A mandrel is received in a chuck of a power drill with the mandrel carrying a thrust bushing which is secured on the mandrel against movement forwardly on the mandrel. A sleeve member is provided to be sandwiched between a rearwardly directed surface on the bearing and a forwardly directly surface on the housing of the drill so as to cause the sleeve member to frictionally engage to the housing against movement relative to the housing.

18 Claims, 9 Drawing Sheets

126
127
171
173
170
172
136
128
174
211
214
212
118
142
402
140
140
301
218
167
168
162
125
144
160
163
164
158
148
125
122
146
150
151
154
156
190
182
183
185
193
180
177
192
176
175
124
187
186
225
183
184
219
125

POWER DRILL HOUSING EXTENSION COUPLING

RELATED APPLICATIONS

This application is a continuation of, and claims priority to, U.S. patent application Ser. No. 08/579,284, filed Dec. 27, 1995 now U.S. Pat. No. 5,662,011.

SCOPE OF THE INVENTION

This invention relates to power tools and, more particularly, to a coupling mechanism for securing a housing extension to a housing of a power drill.

BACKGROUND OF THE INVENTION

Screwdriving apparatus are known for driving collated screws. Typical apparatus adapted to drive collated screws include U.S. Pat. No. 4,146,071 to Mueller et al, issued Mar. 27, 1979, U.S. Pat. No. 3,930,297 to Potucek et al, issued Jan. 6, 1976 and U.S. Pat. No. 4,404,877 to Mizuno et al, issued Sep. 20, 1993.

Each of these patents disclose a power tool comprising a screw gun to which a driver attachment is removably coupled by clamping of the driver attachment onto a forwardly extending extension of the housing which is coaxial about a rotatable shaft. The driver attachments are adapted to receive and successively drive screws such as those collated together in a plastic strip in spaced parallel relation. A useful example of such collated screws are disclosed in U.S. Pat. No. 4,167,229 to Keusch et al, issued Sep. 11, 1979 and related Canadian Patents 1,040,600 and 1,054,982 as well as U.S. Pat. No. 4,930,630 to Habermehl, issued Jun. 5, 1990.

Such driver attachments are known to be relatively, easily be coupled to screw guns which have an extension of the housing comprising a cylindrical surface disposed coaxially about the rotating shaft of the screw gun and onto which the driver attachment can be clamped. Of course, this requires complementary sizing of the cylindrical extension of the housing and a clamp mechanism provided as part of the driver attachment. Other complementary attachment systems can be provided and are known including those in which the driver attachment is adapted for threaded engagement onto a threaded cylindrical extension of the housing.

It is desired to secure driver attachments to power drills having chucks which are adjustable to coaxially clamp drill bits and the like therein. However, power drills typically do not have a housing configuration which permits ease of securing of the driver attachment. Most conventionally available power drills do not, in fact, provide any specific surfaces on the drill to permit securing of a driver attachment. Moreover, the configurations of the front portions of known power drills vary widely from manufacturer to manufacturer and from drill to drill with any manufacturer's line of products. A disadvantage thereby arises that there is no universal coupling which is adapted to couple a driver extension to a variety of power drills.

Typical screw guns incorporate a friction clutch mechanism to stop rotation of a threaded fastener to be driven when the torque exceeds a preset amount. Power drills with chucks have the disadvantage that they typically do not provide a clutch mechanism.

SUMMARY OF THE INVENTION

To at least partially overcome these disadvantages of previously known devices, the present invention provides a housing extension adapted to be coupled to the front end of a drill for securing the housing extension fixed to the housing. The present invention provides a mandrel to be received in a chuck of a power drill with the mandrel carrying a thrust bushing which is secured on the mandrel against movement forwardly on the mandrel. A sleeve member is provided to be sandwiched between a rearwardly directed surface on the bearing and a forwardly directed surface on the housing of the drill so as to cause the sleeve member to frictionally engage to the housing against movement relative the housing.

An object of the present invention is to provide a combination of a tool and a coupling for a housing extension to be secured to a housing of the tool.

Another object of the present invention is to provide an improved coupling for driver attachments for collated screwdrivers which permits the driver attachment to be secured to a wide range of power drills of different configurations.

Another object is to provide a driver attachment for driving collated screws having a universal coupling adapting the driver attachment to be secured to many different power tools.

Another object is to provide a coupling mechanism for attaching driver attachments to power drills which coupling mechanism incorporates a clutch mechanism.

In one aspect, the present invention provides a combination of a power tool having a housing and a coupling mechanism for securing to the housing against movement relative the housing, the housing including a forwardly directed surface, the power tool including:

- a shaft extending forwardly from the housing beyond the forward directed surface; and
- a chuck carried on the shaft forward of the housing,
- the coupling mechanism including:
  - an elongate mandrel secured in the chuck for rotation coaxially with the shaft;
  - a thrust bearing carried on the mandrel preventing sliding of the bearing forwardly relative the shaft and having a rearwardly directed surface; and
  - a sleeve member disposed about the chuck wherein the sleeve member is sandwiched between the forwardly directed surface on the housing and the rearwardly directed surface on the bearing such that the sleeve is secured to the housing against movement relative the housing.

In another aspect, the present invention provides a coupling mechanism for securing to the housing of a power tool about a chuck carried on a rotatable shaft extending from a forwardly directed surface of the tool housing, the mechanism comprising:

- an elongate mandrel having a rear end adapted to be secured in the chuck for rotation coaxially with the shaft,
- a thrust bearing carried on the mandrel forward of the rear end permitting rotation of the mandrel within the bearing yet preventing sliding of the bearing forwardly relative the shaft,
- the thrust bearing having a rearwardly directed surface,
- a sleeve member providing a central cylindrical cavity adapted to be disposed about the chuck, the sleeve member comprising inner and outer telescoping cylindrical sections, threadably coupled together for relative rotation to adjust the length of the sleeve member,
- a forwardmost of the cylindrical sections engaging a rearwardly directed shoulder of the bearing and a forwardmost of the telescoping cylindrical section adapted to engage the forwardly directed surface of the tool housing whereby by adjustment of the length of the sleeve member, the sleeve member may be sandwiched between the forwardly directed shoulder of the housing and the rearwardly directed surface on the bearing to frictionally secure the sleeve member to the housing against movement relative the housing.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 13:
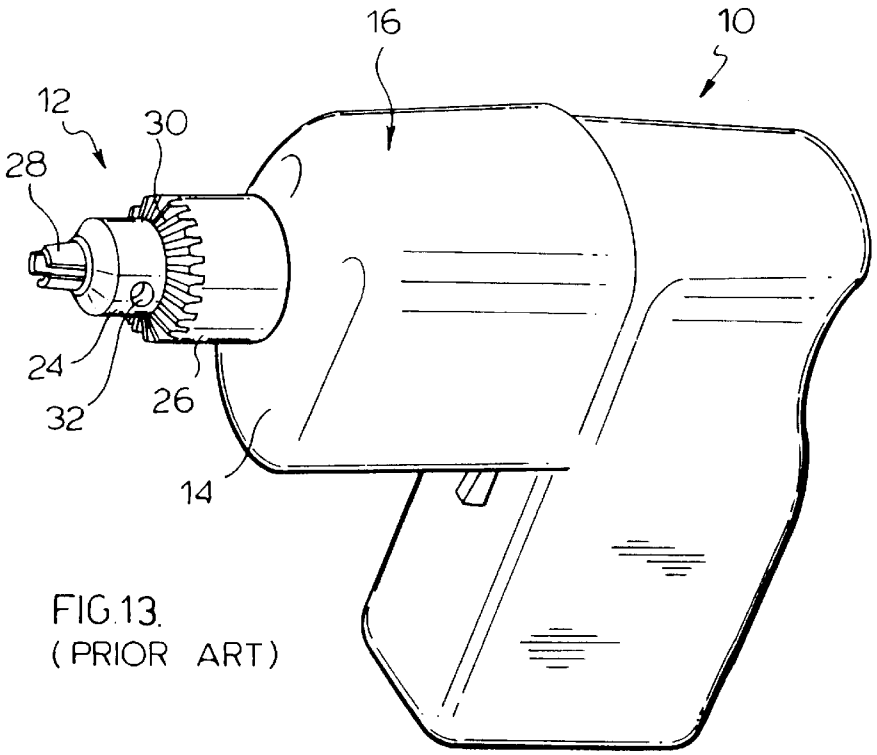
FIG.13. (PRIOR ART)
FIG. 13 is a pictorial view of a typical prior art power drill.

Reference is made first to FIG. 13 which shows a prior art power drill 10 having a chuck 12 which extends forwardly from a forward end 14 of the drill housing 16.

Figure 2:
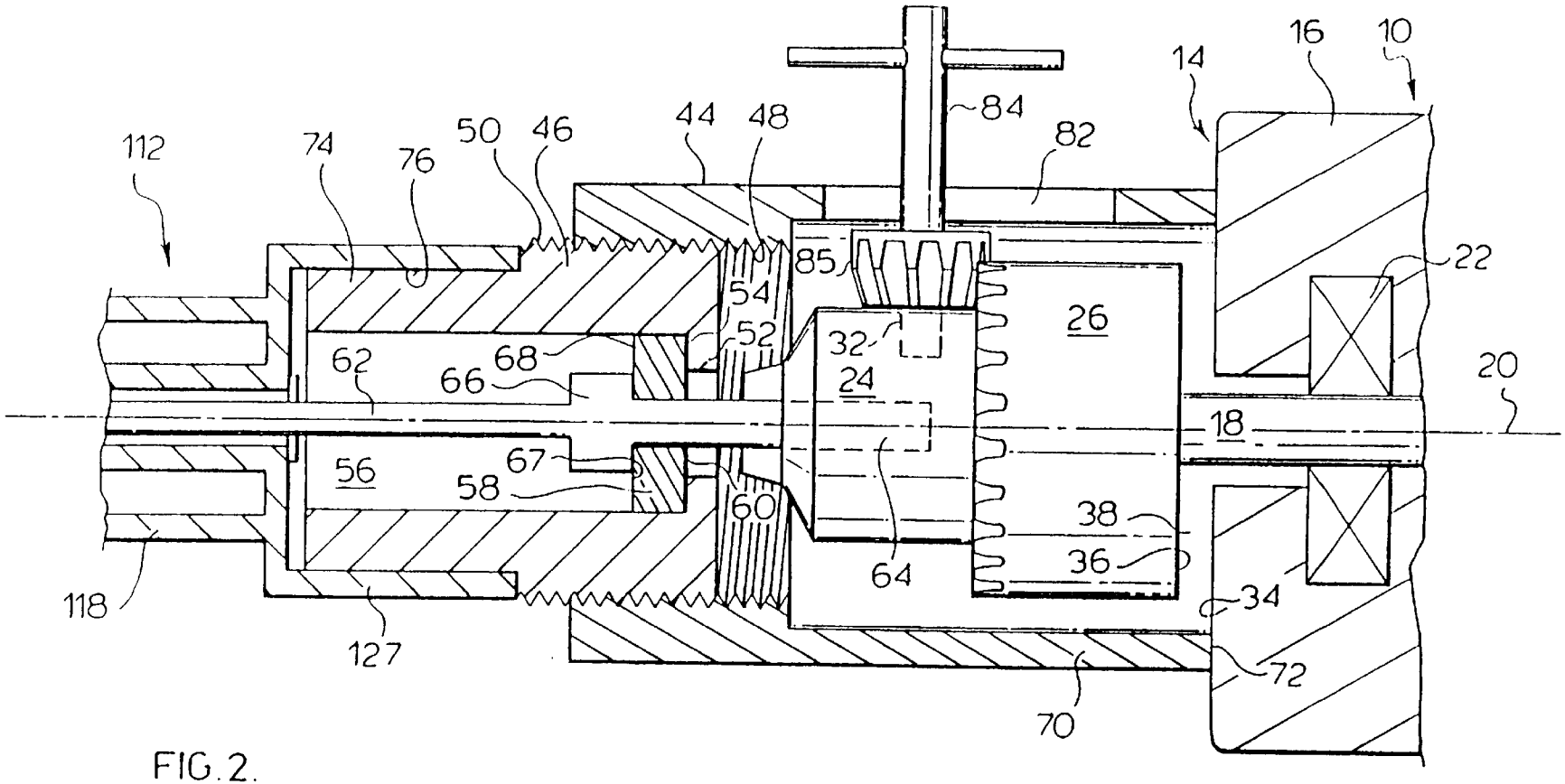
FIG. 2 is a schematic cross-section along the axis of the shaft of the drill in FIG. 1 and showing the entirety of the coupling mechanism as well as a forward portion of the drill and a rear portion of the driver attachment.

As seen in FIG. 2 which includes a cross-section through the front end of the drill and chuck, amongst other things, the chuck is mounted on the forward end of a shaft 18 for rotation with the shaft about a shaft axis 20. The shaft is schematically illustrated as journalled by shaft bearing 22 within the schematically indicated housing 16. As is well known, the shaft 18 is journalled for rotation about the shaft axis 20 in the housing 16 but is otherwise fixed against movement relative the housing 16.

As is well known, the chuck 12 includes a fixed chuck head 24 fixedly secured to the shaft 18 and a collar 26 which is rotatable about the shaft 18. The collar 26 is coupled to movable clamping tong members 28 such that rotation of the collar 26 results in the tong members moving towards or away from the shaft axis 20 so as to engage and clamp an item such as a drill bit in the chuck. Collar 26 carries a toothed end face 30 and the chuck head 24 carries a keyhole 32 such that in a known manner, a key chuck 84 can have an end received in the keyhole 32 such that on rotation of the chuck key, a toothed gear 85 on the chuck key engages the toothed end face 30 and rotates the collar 26 relative the chuck head 24 to release or clamp items such as screw bits within the tong members 28.

As best seen in FIG. 2, the housing 16 has a forward end 14 with a forwardly directed housing surface 34. The chuck has a rearmost surface 36 which is spaced forwardly of the forwardly directed housing surface 34 such that a gap 38 is provided therebetween and by which the rear surface 36 of the chuck is spaced from the forwardly directed housing surface 34. The gap extends radially outwardly relative the shaft axis 20.

Figure 1:
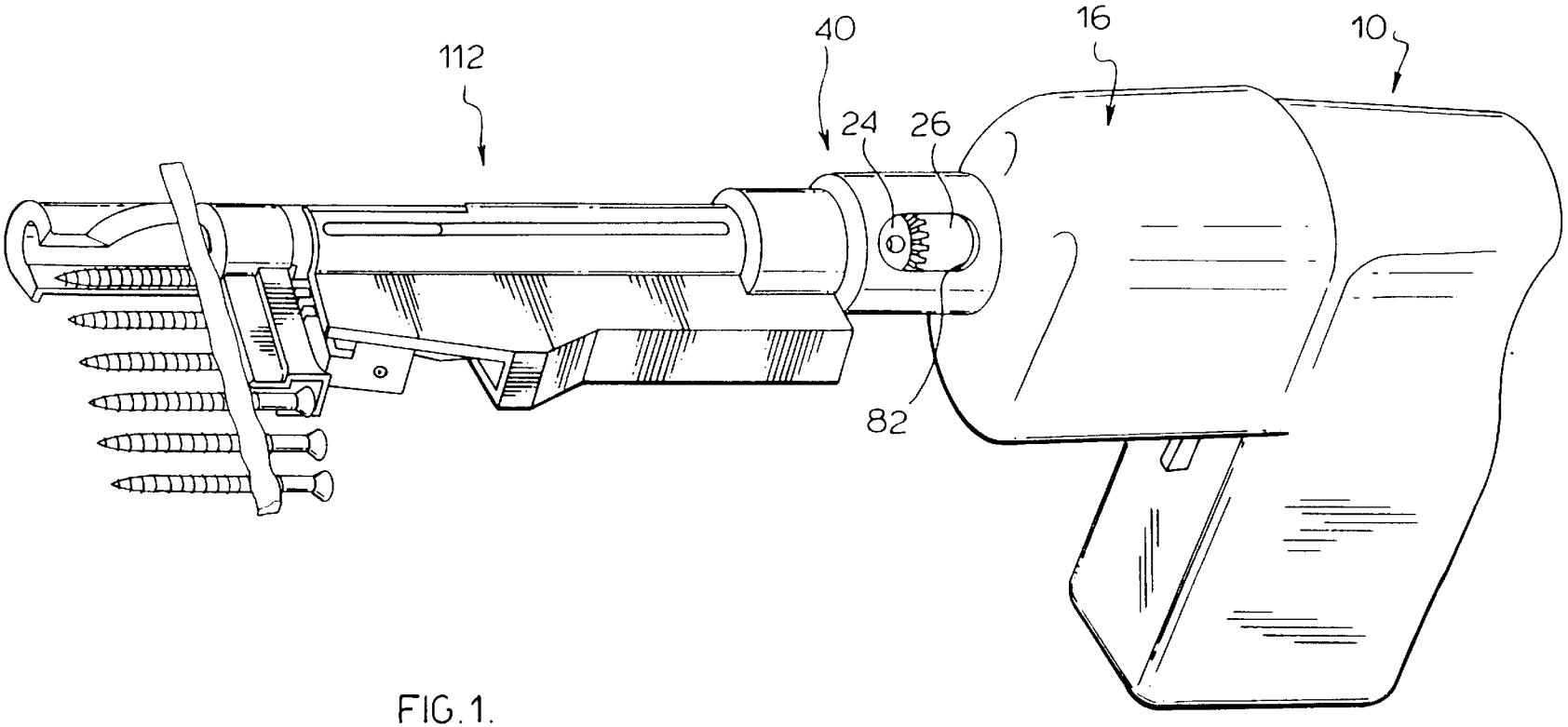
FIG. 1 is a pictorial view of the power drill of FIG. 13 shown with a coupling mechanism in accordance with the present invention securing a driver attachment to the drill for driving screws collated in a strip.

Reference is made to FIG. 1 which shows a coupling mechanism 40 secured, on one hand, to the power drill 10 and, on the other hand, to a driver attachment 112 adapted to drive collated screws. FIG. 2 shows a schematic, partially cross-section view in a plane passing through the axis of the shaft 20 of the drill and illustrating the entirety of the coupling mechanism 40, a forward portion of the drill 10 and a rear portion of the driver attachment 112. The coupling mechanism 40 comprises a collar member formed by rear collar segment 44 and forward collar segment 46. Each, in effect, comprises a cylindrical sleeve. The rear collar segment 44 carries near its forward end inwardly directed cylindrical threaded surface 48 which is complementary to and threadably engages outwardly directed cylindrical threaded surface 50 on the forward collar segment 46. The collar member is thus, effectively, length adjustable by relative rotation of the rear collar segment 44 and forward collar segment 46 to increase or decrease the extent to which the threaded surfaces 48 and 50 overlap.

Forward collar segment 46 has a radially inwardly extending flange 52 at its rear end which provides a forwardly directed shoulder 54 directed forwardly into the cylindrical bore 56 of the forward collar segment 46. A thrust bearing 58 is provided within bore 56 with a rearwardly directed bearing surface 60 engaging the shoulder 54 of the forward collar segment 46 to prevent movement of the collar member forwardly relative the thrust bearing 58.

An elongate mandrel 62 has its rear end 64 clamped within the chuck 12 for rotation of the mandrel 62 with the shaft 18 about the axis 20 and with the mandrel secured to the chuck against movement forwardly relative the chuck, the shaft 18 and, therefore, the drill 10.

The mandrel carries an enlarged boss 66 providing a rearwardly directed shoulder 67 which engages a forwardly directed bearing surface 68 of thrust bearing 58. It is clear that with the mandrel 62 secured in the chuck against movement forwardly relative the chuck, the thrust bearing 58 is prevented by the enlarged boss 66 from moving forwardly on the mandrel and the forward collar segment 46 is prevented from forward movement by the thrust bearing 58.

With forward collar segment 46 secured to the chuck against forward movement, by relative rotation of the rear collar segment 44 relative the forward collar segment 46, a rearward end 70 of the rearward collar segment 44 carrying rearwardly directed collar surface 72 may be urged rearwardly into engagement with the forwardly directed housing surface 34 with sufficient forces directed parallel the shaft axis 20 so as to have the rearward end 70 of the rear collar segment 44 frictionally engage the housing 16 and secure the rearward collar segment 44 and, thus, the coupling mechanism 40 to the housing 16 of the drill against relative movement. In effect, the collar member is sandwiched between the rearwardly directed bearing surface 60 of the thrust bearing 58 and the forwardly directed housing surface 34 of the drill.

Forward collar segment 46 is provided with a forwardmost portion 74 having a cylindrical outer clamp surface 76 adapted to have a complementary cylindrical socket-forming clamp member 127 of a housing extension 118 of the driver attachment 112 secured to the coupling mechanism 40 and, hence, to the housing 16 of the power drill against movement relative the power drill housing.

As shown, the collar member and, particularly, the rear collar segment 44 is disposed coaxially about the chuck 12 clear of engagement with the chuck 12 so as to permit free rotation of the chuck 12 about the shaft axis 20. The mandrel 62 is clamped into chuck 12 and is rotatable therewith with the thrust bearing 58 permitting the mandrel 62 to rotate freely with the chuck. The thrust bearing 58 has outward radially directed surfaces which are sized to be closely received within the bore 56 of the forward collar segment 46 and, thus, coaxially locate the forward collar segment 46 and the coupling mechanism 40 about the shaft axis 20.

In FIGS. 1 and 2, the rear collar segment 44 is shown as provided with a chuck key slot 82 provided to permit a chuck key 82 as shown to extend radially through the slot 82 for engagement with the keyhole 32 and the toothed end face 30 of the chuck for tightening and loosening of the chuck. Slot 82 is elongate in a direction parallel the axis of the shaft so as to accommodate different locations of keyholes in chucks of different drills.

The coupling mechanism 40, as illustrated in FIG. 2, can be secured to the drill by the coupling mechanism including the thrust bearing 58 and the mandrel 62 slid rearwardly coaxially relative to the chuck such that the mandrel slides inside the chuck and with the rear end 70 of the rear collar segment 46 to loosely engage the front end 14 of the housing 16. In this position, the chuck key may be inserted radially through the slot 82 and used to tighten the chuck onto the mandrel. The chuck key is then withdrawn. Next, by relative rotation of the forward collar segment 46 and the rear collar segment 44, the length of the collar member may be slightly increased so as to frictionally urge the rearwardly directed collar surface 72 into frictional engagement with the forwardly directed housing surface 34 and thereby frictionally couple the collar member and, thereby, the coupling mechanism 40 to the housing 16 against relative movement. Removal can be effected by a reverse step, notably, by reducing the length of the collar member, rotating the loose collar member to a position in which the slot 82 overlies the keyhole 32 and using the key chuck to release the mandrel.

It is not necessary that the slot 82 be provided. For example, with the rear collar segment 44 removed from engagement with the forward collar segment 46, the mandrel 62 carrying the thrust bearing 58 and the forward collar segment 46 may be clamped in the chuck using the chuck key. Thereafter, the forward collar segment 44 may be slid coaxially rearwardly about the rear collar segment 46 and threaded rearwardly relative the rear collar segment 46 into engagement with the front end 14 of the housing 16. While the invention has been illustrated with a chuck operative with a chuck key, the invention is equally operative with keyless chucks.

Figure 3:
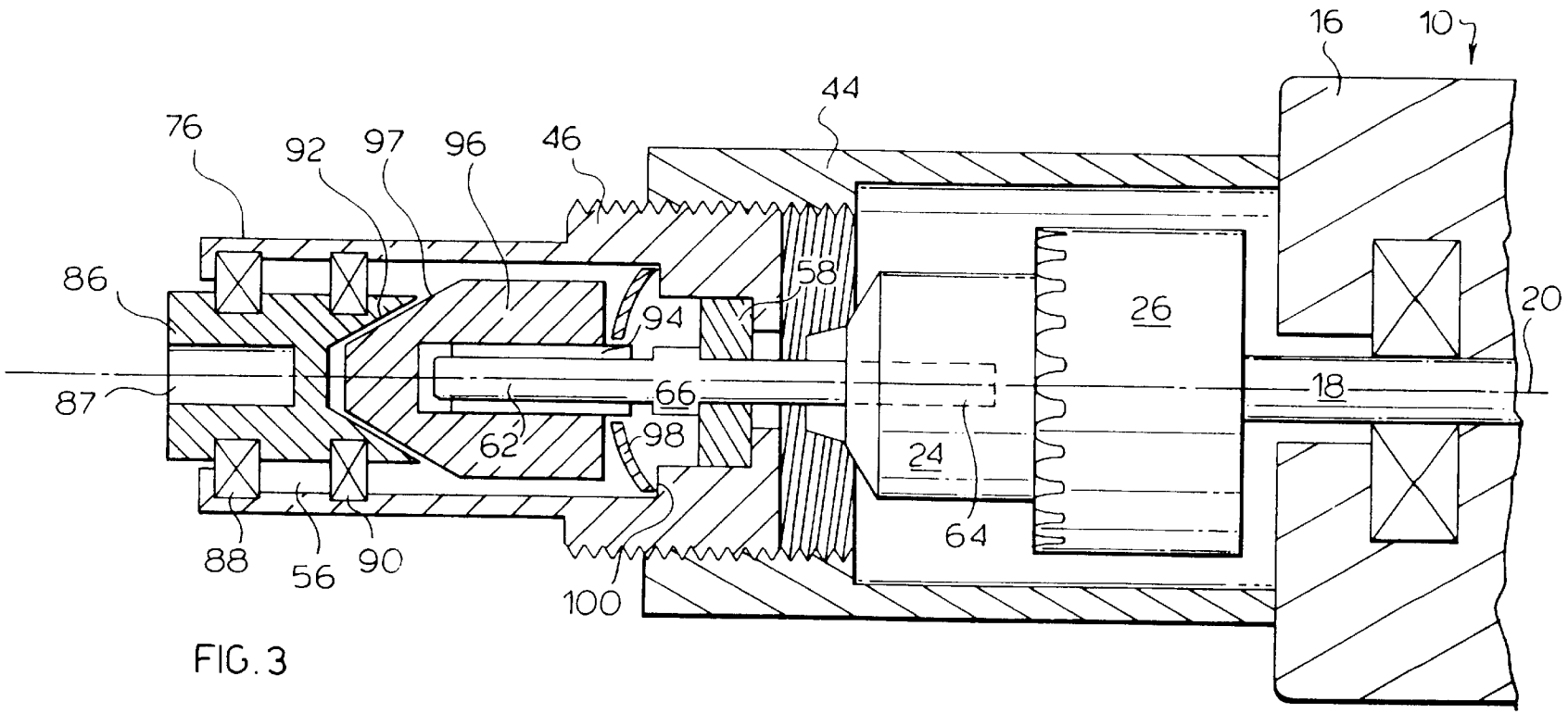
FIG. 3 is a cross-sectional view similar to FIG. 2 but showing a coupling mechanism similar to that of FIG. 2 but incorporating a clutch mechanism.

Reference is now made to FIG. 3 which shows a cross-section similar in many respects to FIG. 2, however, showing a modified form of the forward collar segment 46 adapted so as to provide a clutch mechanism.

FIG. 3 schematically shows a socket-forming member 86 journalled in bore 56 for rotation about axis 20 by bearings generally indicated 88 and 90. The socket-forming member 86 has at its front end, a hexagonal socket 87 adapted to receive known hexagonal bits for screwdrivers therein. A rearward end of the socket-forming member 86 is provided with frustoconical surfaces 92. The socket-forming member 86 is fixed within the forward collar segment 46 against movement forwardly or rearwardly.

The mandrel 62 carries axially extending splines 94. A clutch member 96 is provided on the mandrel axially slidable relative the mandrel by reason of the clutch member having axially extending keyways corresponding to the splines 92. Clutch member 96 has a forwardmost frustoconical surface 97 adapted to mate with and to be complementary to the rear conical surface 92 of the socket-forming member 86.

A disc spring 98 engages a rearwardly directed shoulder 100 formed in the forward collar segment 46 so as to bias the clutch member 96 forwardly into engagement with the socket-forming member 86. The disc spring 98 urges the clutch member 96 into the socket-forming member 86 with sufficient pressure such that the frictional engagement between the conical surfaces 92 and 97 transmit rotational forces from the clutch member 96 to the socket-forming member 86 and, hence, on, for example, to a bit engaging a screw to be driven into a workpiece. To the extent that a screw may be fully driven into a workpiece and the torque required to continue to rotate the screw substantially increases, the frictional engagement between the clutch member 96 and the socket-forming member 86 will not be sufficient for continued rotation of the socket-forming member 86 having regard, amongst other things, to the forces applied by the disc spring 98. Thus, on a screw being fully driven into a workpiece, the clutch mechanism serves to disengage a bit engaging the screw from rotation with the shaft 18.

The embodiment of the coupling mechanism 40, illustrated in FIG. 3 and including a clutch mechanism, is particularly adapted to be secured to a power drill and, in effect, convert the power drill into a screw gun which incorporates a clutch mechanism. While only one form of a clutch mechanism is shown, many other forms of clutch mechanisms may be utilized.

The forward end of the forward collar segment 46 is provided with outer cylindrical surface 76 about which a driver attachment such as illustrated in FIG. 1 can be attached.

Reference is now made to FIGS. 4, 5, 6 and 7 which show a second embodiment of a coupling mechanism 40 in accordance with the present invention and in which similar reference elements are also used to refer to similar elements.

Figure 4:
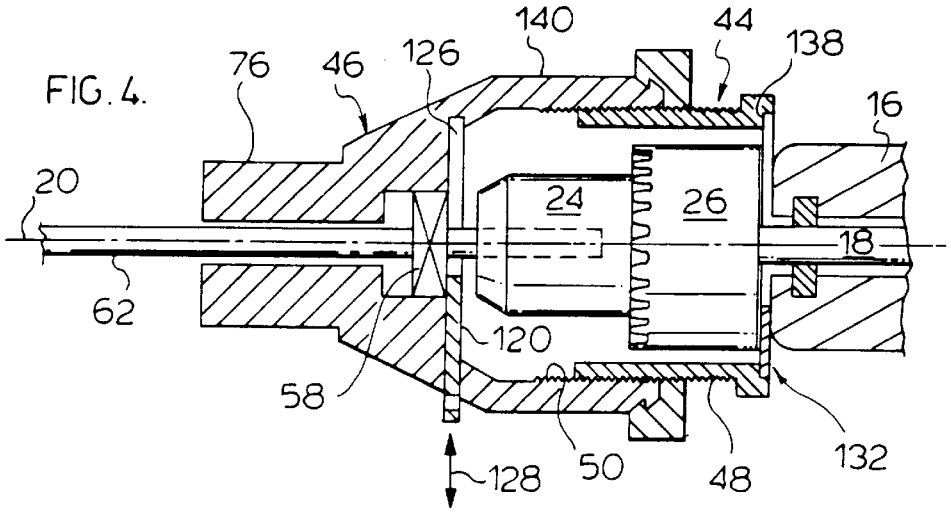
FIG. 4 shows a side cross-section similar to that of FIG. 2, however, illustrating a second embodiment of a coupling mechanism secured to the front of a drill having a different configuration to that shown in FIG. 1.
Figure 5:
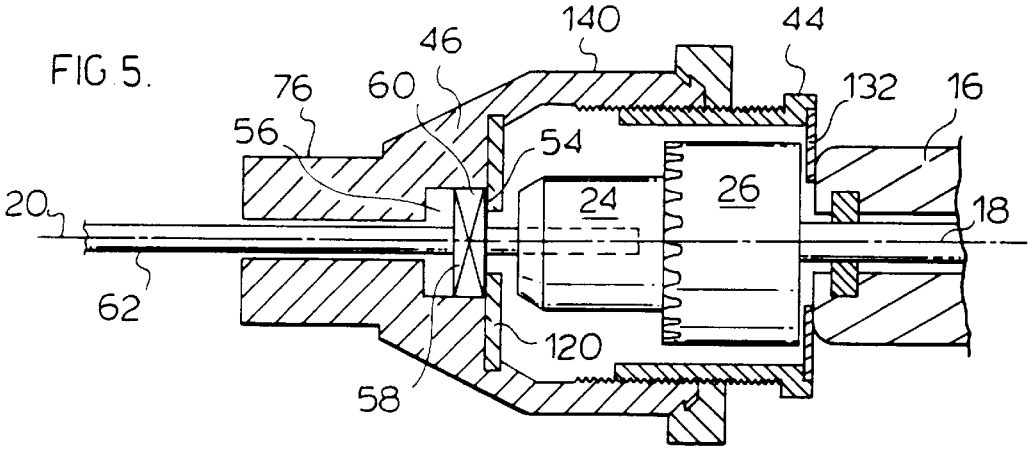
FIG. 5 comprises a top cross-section through the device shown in FIG. 4.

FIG. 4 illustrates a schematic cross-sectional side view, somewhat similar to that shown in FIG. 2, while FIG. 5 shows a top view in a plane perpendicular to the view of FIG. 4.

As seen, the rear collar segment 44 is provided radially inwardly of the forward collar segment 46 with the rear collar segment 44 having external cylindrical threaded surfaces 48 and the forward collar segment 46 having internal cylindrical threaded surfaces 50. The forward collar segment 46 has a rearwardly opening cylindrical bore sized to receive the thrust bearing 58 therein. As best seen by a comparison of FIGS. 5 and 6, a bearing locking pressure 120 plate is provided rearward of the thrust bearing 58 and, in effect, the bearing plate 120 provides forwarding directed shoulder surfaces 54 to be engaged by the rearwardly directed bearing surface 60. The bearing plate 120 is illustrated in a front view in FIG. 7 and is provided with a central opening 122 adapted to be disposed about the mandrel 62 and with the opening 122 extending as a slot 124 to one side. The forward collar segment 46, in effect, has a radially extending slotway 126 sized to receive the bearing plate 120 and to permit the bearing plate 120 to be removed or inserted by sliding inward and outward of the slotway 126 in directions indicated by the arrow 128 in FIG. 5. Bearing plate 120 is provided with a small opening 130 to assist in engagement of the bearing plate for removal.

Figure 6:
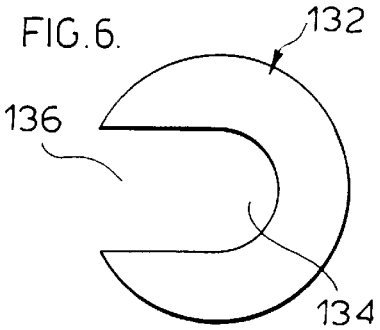
FIG. 6 comprises a front view of the locking plate illustrated in FIGS. 4 and 5.

In the embodiment of FIGS. 5 and 6, the thrust bearing 58 is secured as in a forced fit relation about the mandrel 62 so as to prevent the thrust bearing from being moved forwardly relative the mandrel.

FIGS. 5 and 6 show a configuration of the front end of the housing of a drill 10 which differs from that in shown in FIGS. 3 and 4. In FIGS. 5 and 6, the housing 16 does not extend radially of the shaft axis beyond an outermost radius of the chuck. To permit the rear end 70 of the rear collar segment 44 to engage the forwardly directed housing surfaces of the housing 16 about the shaft, a pressure plate 132 is provided disposed in the gap 38 between the rear surface 36 of the chuck and the forwardly directed housing surface 34. The pressure plate 132 has a central opening 134 adapted to be coaxially received about the shaft 18 radially spaced therefrom. The opening 134 opens radially as a slot 136 open to the side of the pressure plate 132 so as to permit the pressure plate 132 to be located in a desired position by sliding radially into the gap 38. The pressure plate 132 is of a thickness which is less than the thickness of the gap as measured parallel the shaft axis 20 such that on the pressure plate 32 being urged rearwardly into the housing 16, the pressure plate is free and clear of the chuck 12 and the shaft 18 which are free to rotate.

As seen in FIGS. 5 and 6, the front end 14 of the rear collar segment 44 is provided with a recessed annular step shoulder 138 sized to match the outer perimeter of the pressure plate 132 and assist in coupling the pressure plate 132 to the rear collar segment 44.

In use of the coupling mechanism 40 of FIGS. 5 and 6, with the mandrel 62 coupled in the chuck and the plates 120 and 132 positioned as shown in FIGS. 5 and 6, by relative rotation of the rear collar segment 44 and the forward collar segment 46, the collar member is sandwiched between the thrust bearing 58 and the housing 16 by reason of transfer of pressures from the bearing plate 120 to the forward collar segment 46 to the rear collar segment 44 and to the pressure plate 132. In this manner, the pressure plate 132 and, hence, the entire coupling mechanism may be frictionally urged into the forwardly directing housing surfaces of the housing 16 so as to secure the coupling mechanism 40 to the housing 16 against relative movement.

Securing of the coupling mechanism 40 to a drill may be accomplished in the following steps. Firstly, the mandrel 62 carrying merely the thrust bearing 58 may be secured in the chuck in a known manner. Next, the forward collar segment 46 with the rear collar segment 44 is readily coupled about the mandrel by sliding axially about the mandrel rearwardly until the thrust bearing is suitably engaged within the bore 56 in the forward collar segment 46. In this position, the bearing plate 120 may be slid radially into the slotway 126 to be disposed rearward of the thrust bearing 58 as shown in FIGS. 4 and 5. Next, the pressure plate 132 may be slid radially into the gap 38 between the chuck 12 and the housing 16 and located in the step shoulder 138 of the rear collar segment 44. Subsequently, by increasing the length of the collar member by relative rotation of the forward collar segment 46 and the rear collar segment 44, the coupling mechanism may be urged into frictional engagement with the housing 16.

The coupling mechanism 40 illustrated in FIG. 4 also includes a clamp surface 76 about which driver attachment 112 as illustrated in FIG. 2 may be secured.

Figure 8:
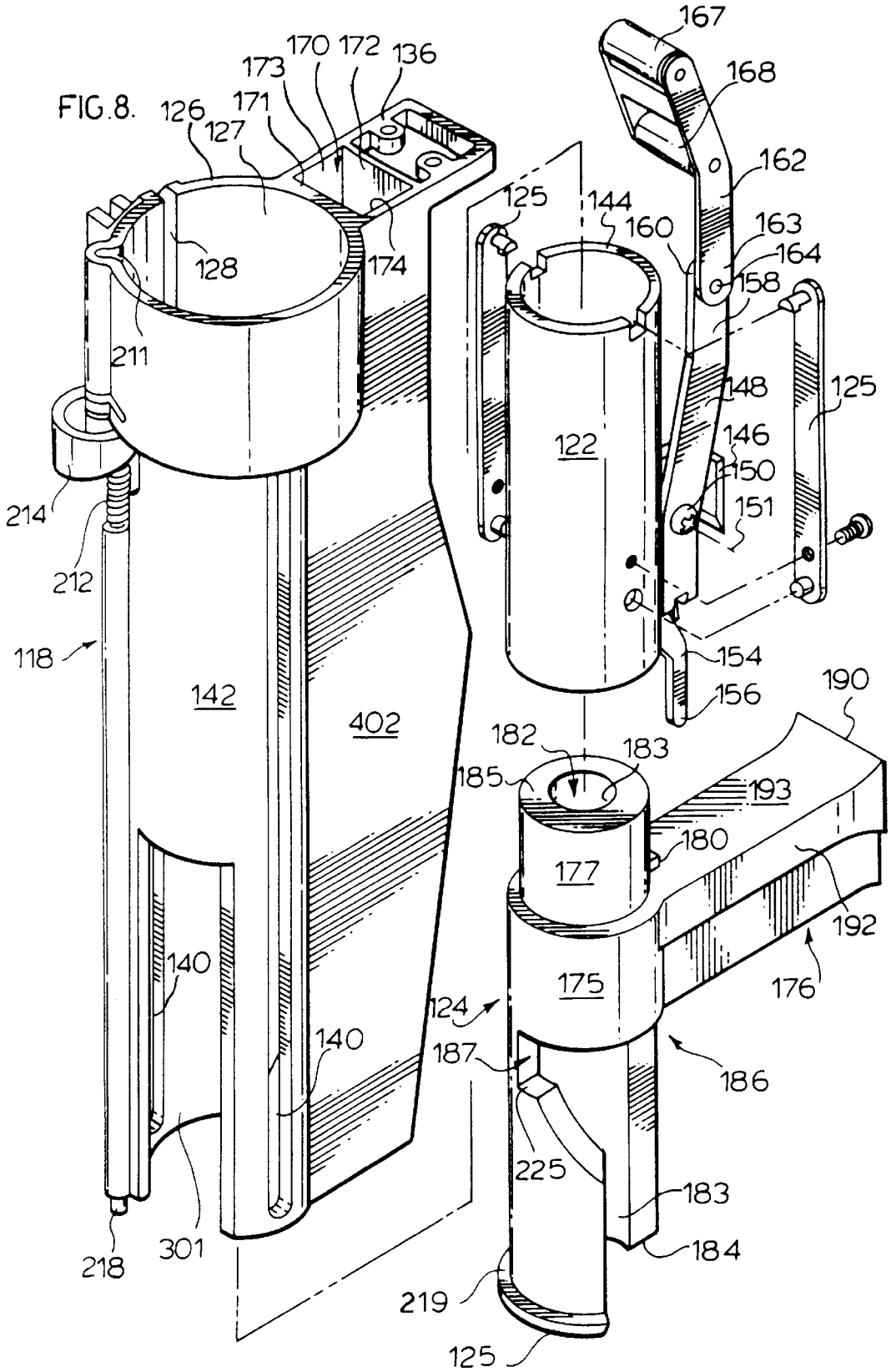
FIG. 8 is an exploded pictorial view of the driver attachment shown in FIG. 6.

It is to be appreciated that a pressure plate 132 as illustrated in FIGS. 5, 6 and 8 may also be adapted for use with a coupling mechanism as illustrated in FIG. 4. Preferably, the coupling mechanism of either FIG. 2 or FIG. 4 would be provided with suitable pressure plates which pressure plates, such that the coupling mechanism 40, with or without the pressure plates, is adapted for coupling to a wide variety of configurations of drill housings. It is to be appreciated that with some drill housing configurations, even though the front end of the drill housing may extend radially beyond a maximum diameter of the chuck, it may be advantageous or necessary to use a pressure plate 132 so as to permit engagement with forwardly directed housing surfaces 34 which assist in transferring forces between the rear collar segment 44 and the housing 16 parallel the shaft axis 20 and without tending to place the forward collar segment 44 in an orientation which is not disposed coaxially relative the shaft axis 20.

The preferred pressure plate 136 illustrated is merely a flat plate, preferably of metal. Such pressure plates could have a rearwardly directed surface which is customized for particular drills and provide a three-dimensional mirror image of the forwardly directed surface 34 of the drill with a rear surface adapted to engage with the rear sleeve segment 44.

The illustrated coupling members each provide a cylindrical clamp surface 76 for coupling, for example, of a driver attachment illustrated as 112. It is to be appreciated that many other mechanisms may be provided on the coupling mechanism 40 to permit various power takeoff devices to be attached to the coupling mechanism 40 and thereby form extensions of the housing 16 of the drill which extensions are fixed to the housing 16 of the drill against relative rotation. In the embodiments shown in FIGS. 2 and 4, not only could the surfaces indicated as 76 provide a clamp surface but, also, the outermost cylindrical surface indicated as 140 could also provide a clamp surface. Of course, any clamping surfaces need not be cylindrical but merely need to be complementary to coupling sockets or other mechanisms of any housing extensions desired to be secured.

FIGS. 1 and 2 illustrate an embodiment in which a driver attachment 112 is secured via the coupling mechanism 40 to the power drill 10. It is to be appreciated that the coupling mechanism could be provided as an integral part of the driver attachment. Such a configuration is, of course, illustrated in FIG. 3 in which the coupling mechanism includes as a functional component, a clutch mechanism. It is to be appreciated that a unitary element could be provided incorporating driver attachment 112, the clutch mechanism and the coupling mechanism 40.

Preferred driver attachments which may be secured to a power drill using the coupling mechanism in accordance with the present invention are attachments which are relatively lightweight. It is to be appreciated that in use of a driver attachment such as 112, the coupling mechanism principally needs to provide a sufficiently strong to the coupling of the housing as to support the weight of the driver attachment 112. In use of a driver attachment 112 to drive screws, principal forces being applied between, for example, a screw to be driven and the tool, are applied directly through the shaft, chuck and mandrel without substantially any forces tending to urge the coupling mechanism 40 forwardly off the housing 16 or tending to rotate the coupling mechanism 40 relative the housing 16. However, preferred driver attachments 112 would be those attachments which are relatively lightweight. The coupling mechanism may be used for coupling attachments which translate the rotary motion into other motions such as orbital sanding and reciprocal sawing motions.

Figure 7:
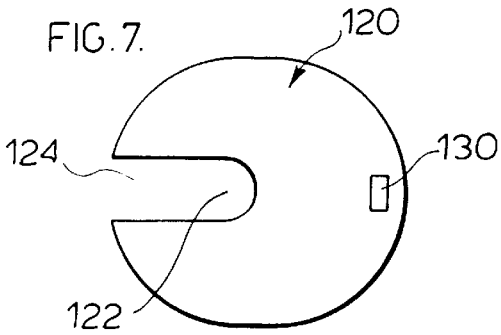
FIG. 7 shows a front view of the pressure plate illustrated in FIGS. 4 and 5.

Reference is now made to FIG. 7 which shows a driver attachment 112. The driver attachment 112 is adapted to receive a collated screwstrip 114 with spaced screws 116 to be advanced by the driver attachment 112, located in alignment with a screwdriver bit and subsequently driven into a workpiece on the user urging the drill 10 into a workpiece. The structure of the preferred driver attachment 112, shown in FIG. 1, is described below with reference to FIGS. 8, 9, 10, 11 and 12.

In overview, the driver attachment 112 has a rearwardly directed socket 127 complementary to the cylindrical surface 76 on the coupling mechanism for coupling of the driver attachment 112 to the drill 10 and with a driver shaft 134 to be received in the chuck 12. The driver attachment has a housing 118 which is secured to the housing 16 of the drill 10 via the socket 127. A slide body 120 is slidable relative the housing coaxially about the drive shaft 134 for reciprocal inward and outward movement and is biased by a spring 138 outwardly away from the housing 118. The slide body carries a guide mechanism for guiding screws in the screwstrip into and maintaining a screw to be driven in axial alignment with the drive shaft 134 and a mechanism for successively advancing screws in the screwstrip.

Driver Attachment

Figure 10:
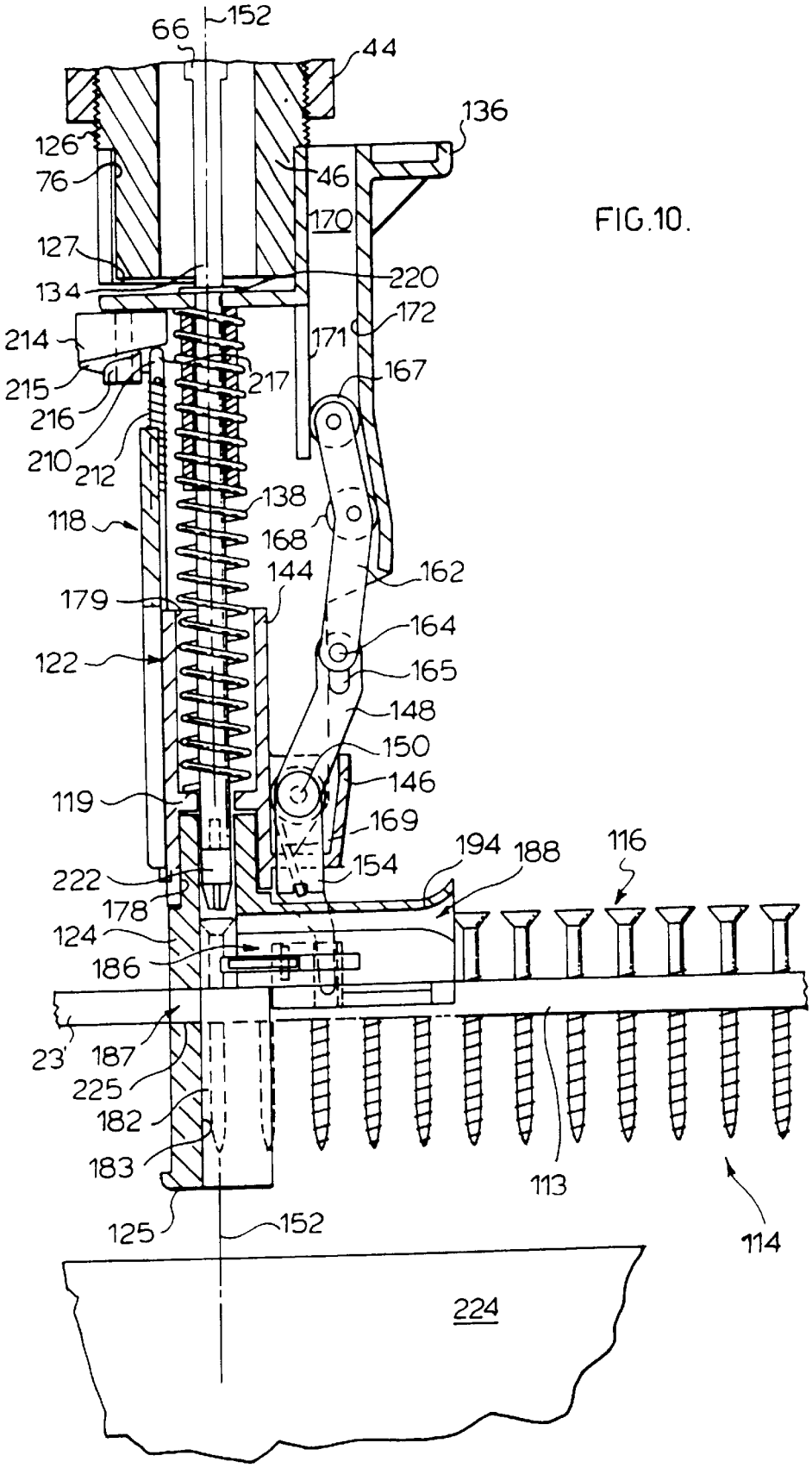
FIG. 10 is a schematic partially cross-sectional view of the driver attachment of FIG. 8 in a fully extended position as seen in FIG. 8 to a plane passing through a longitudinal axis of the drive shaft and centrally of the screws in the screwstrip.
Figure 11:
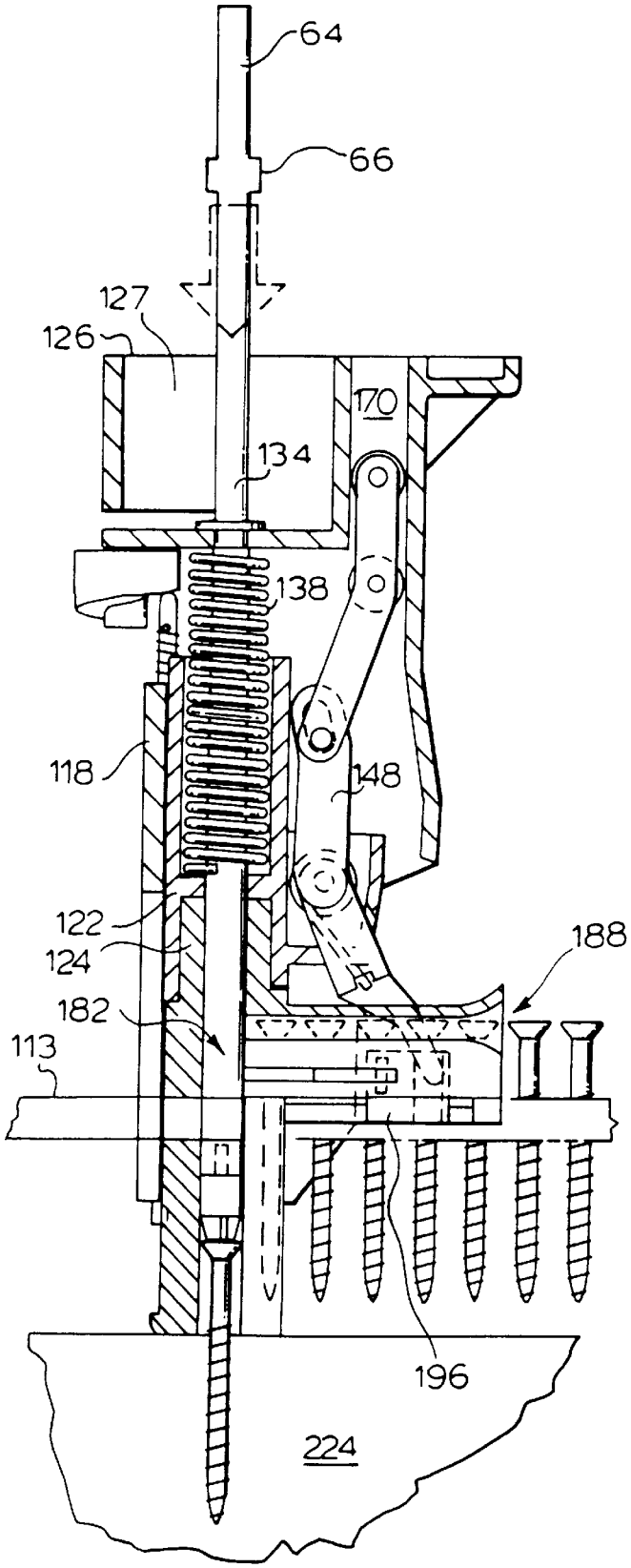
FIG. 11 is a view identical to FIG. 10 but with the driver attachment in a partially retracted position in driving a screw into a workpiece.

Reference is made to FIG. 8 showing an exploded view of major components of the driver attachment 112 as housing 118 and a slide body comprising a rear portion 122 and a removable nose portion 124. FIGS. 10 and 11 show in cross-section the interaction of these components.

As seen in FIG. 10, the rearmost end 126 of the housing 118 has a rearwardly directed socket 127 with a longitudinal slot 128 in its side wall to receive and securely clamp the housing 118 onto the cylindrical surface 76 of the coupling mechanism 40 so as to secure the housing 118 of the driver attachment to the housing 16 of the drill 10 against relative movement. The chuck 12 of the drill releasably engages a hexagonally shaped end of the driver shaft 134 in known manner. The housing 118 is provided with a lateral flange 136 at its rear end to which a known screwstrip containing cartridge 119 may optionally be secured in a conventional manner as shown in FIG. 10.

As seen in FIG. 10, the slide body 120 is slidably received in the housing 118 with the driver shaft 134 received in a bore passing through the rear portion 122 and nose portion 124 of the slide body 120. A compression spring 138 disposed between the housing 118 and the rear portion 122 coaxially about the driver shaft 134 biases the slide body away from the housing 118 from a retracted position towards an extended position. As shown, the spring 138 is disposed between the housing 118 and the rear portion 122. Slide stops 125, best shown in FIG. 8, are secured to the rear portion 122 of the slide body. Two slide stops 125 slide in two longitudinal slots 140 on each side of the part cylindrical side wall 142 of the housing 118 to key the rear portion 122 of the slide body to the housing 118 against relative rotation and to prevent the slide body being moved out of the housing 118 past a fully extended position.

The rear portion 122 comprises a generally cylindrical element 144 with a radially extending flange element 146 on one side. A lever 148 is pivotally mounted to the flange element 146 by bolt 150 normal to a longitudinal axis 152 which passes centrally through the drive shaft 134 and about which the drive shaft is rotatable. Lever 148 has a forward arm 154 extending forwardly to its front end 156 and a rear arm 158 extending rearwardly to its rear end 160. A cam follower 162 has its forward end 163 mounted to the rear end 160 of the rear arm 158 by a bolt 164 being received in a slot 165 extending longitudinally in the rear end of the rear arm 158. The cam follower 162 has at its rear end 166 two cam rollers 167 and 168 rotatable on pins parallel to the axis of bolts 150 and 164.

As seen in FIGS. 8 and 10, the housing 118 carries a camming channel 170 in which the cam rollers 167 and 168 are received. The camming channel 170 is disposed to one side of the driver shaft 134 and extends generally parallel thereto. The camming channel 170 has opposed camming surfaces 171 and 172 at least partially closed by side walls 173 and 174.

The camming channel 170 extends rearwardly beside the socket 127 of housing 118 and, thus, rearwardly past the cylindrical support surface 82 of the screw gun 10 to one side thereof. This configuration permits the use of a housing 118 which is of a lesser length parallel longitudinal axis 152 for a given length of the cam follower 162 and of the lever 148, rearward of bolt 150.

A spring 169 wound about bolt 150 is disposed between the flange element 146 and the forward arm 154 of the lever 148 to bias the lever in a clockwise direction as seen in FIG. 10. The effect of spring 169 is to urge the cam roller 167 into engagement with cam surface 171 and to urge cam roller 168 into engagement with cam surface 172.

With relative sliding of the slide body 120 and the housing 118 between the extended and the retracted positions, the cam follower 62 translates the relative movement and positioning of the slide body 120 and housing 118 into relative pivoting and positioning of the lever 48 about the axis 151. The ability of bolt 164 to slide longitudinally in the longitudinal slot 65 provides a lost motion linkage as is known and has advantages such that the relative timing of pivoting of the lever 148 varies as compared to the relative location of the slide body 120 and housing 118 in moving towards an extended position as contrasted with moving towards a retracted position.

The nose portion 124 has a generally cylindrical screw guide element or guide tube 175 arranged generally coaxially about longitudinal axis 152 and a flange-like screw feed channel element 176 extending radially from the guide tube 175.

The guide tube 175 has a cylindrical portion 177 at its rear end with a cylindrical exterior surface sized to be closely received, preferably in a friction fit, within a forwardly opening cylindrical bore 178 in the forward end of the rear portion 122. A radially extending key 180 is provided to extend from the cylindrical portion 177 of the nose portion 124 to be received in a correspondingly sized keyway slot 182 in the rear portion 122 as best seen in FIG. 10 to secure the nose portion 124 to the rear portion 122 against relative pivoting about the longitudinal axis 152.

The guide tube 175 has a cylindrical bore or guideway 182 extending axially through the guide tube with the guideway 182 delineated and bordered by a radially extending cylindrical sidewall 183 and open at its forward axial end 184 and at its rearward axial end 185.

The guide tube 175 has a rearward section adjacent its rear end 185 in which the side wall 183 extends 360° about the guideway 182. Forward of the rearward section, the guide tube has a forward section best seen in FIG. 10 and which has an access opening 86, shown in the drawings as being on the right hand side of the guide tube 175. Screw access opening 186 is provided to permit the screwstrip 114 including retaining strip 113 and screws 116 to move radially inwardly into the guideway 182 from the right as seen in FIGS. 10 and 11. Each screw, preferably, has a head 117 with a diameter marginally smaller than the diameter of the side wall 183. It follows that where the head of the screw is to enter the guideway 182, the screw access opening must have a circumferential extent of at least 180°. Where the shank 208 of the screw is to enter the guideway, the screw access opening may have a lesser circumferential extent.

In the forward section, the side wall 183 of the guide tube 175 engages the radially outermost periphery of the head 117 of the screw 116, to axially locate the screw head 117 coaxially within the guideway 182 in axial alignment with the drive shaft 134. In this regard, the side wall 183 preferably extends about the screw sufficiently to coaxially locate the screw head and thus, preferably, extend about the screw head at least 120°, more preferably, at least 150° and, most preferably, about 180°.

An exit opening 187, shown towards the left hand side of the guide tube 175 in FIGS. 10 and 11, is provided of a size to permit the spend plastic strip 113 from which the screws 116 have been driven to exit from the guideway 182. Forwardly of the exit opening 187, the side wall 183 of the guide tube 175 is shown as extending greater than about 180° about the longitudinal axis 152 so as to continue to provide a side wall 183 which can assist and positively coaxially guiding the head 117 of a screw 116 being driven.

Figure 9:
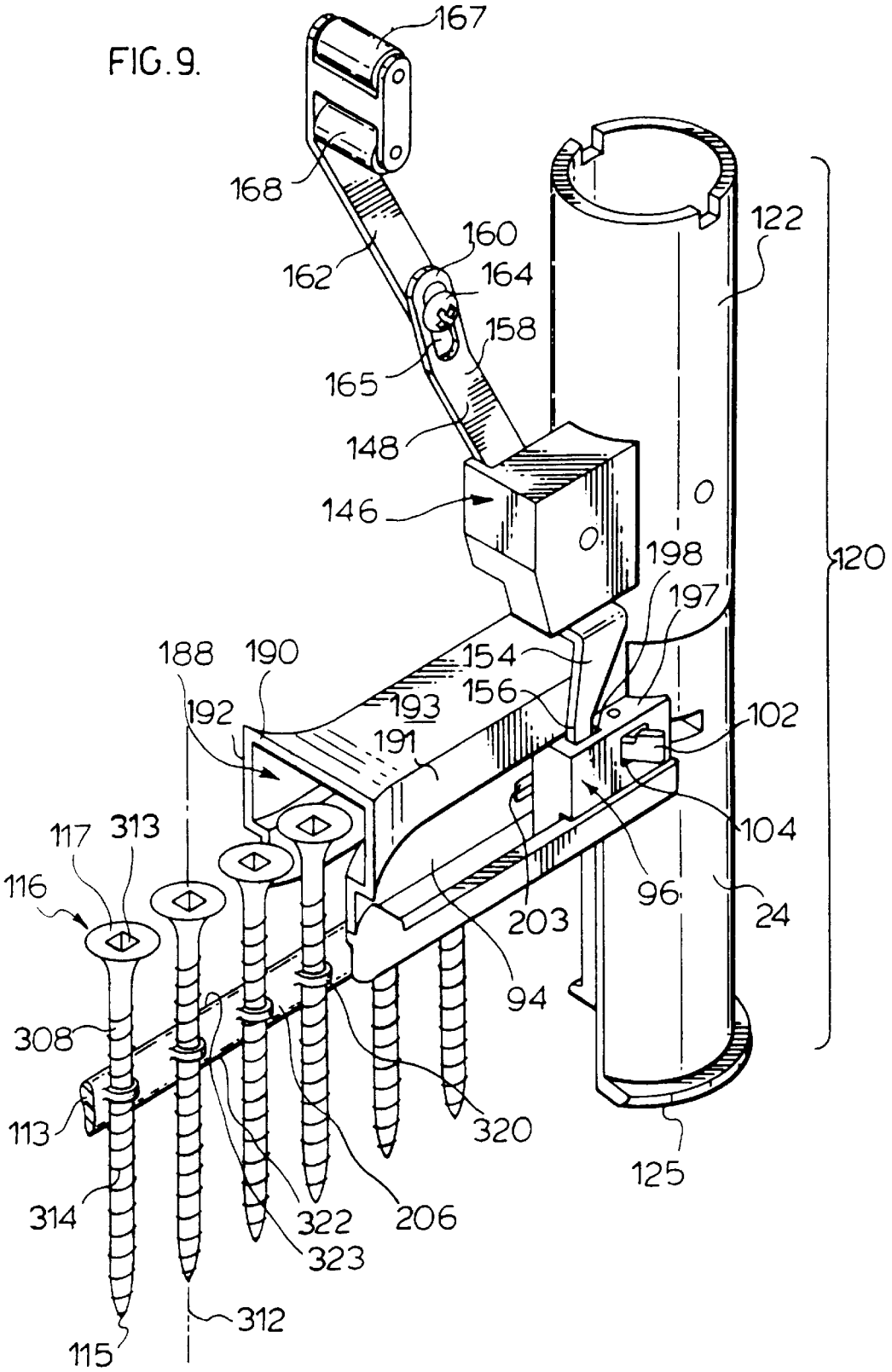
FIG. 9 is a pictorial view of the opposite side of the slide body of the driver attachment shown in FIG. 8 but with a screwstrip positioned therein.

The screw feed channel element 176 is best seen in FIGS. 9 and 10 as providing a channelway 188 which extends radially relative the longitudinal axis 152 to intersect with the guideway 182 in the guide tube 175. In this regard, the channelway 188 opens to the guideway 182 as the screw access opening 186. The channelway 188 provides a channel of a cross-section similar to that of the screw access opening 186 from the screw access opening 186 to a remote entranceway opening 190. The channelway 188 is defined between two side walls 191 and 192 joined by a top wall 193. The major side wall 191 is shown as extending from the heads 117 of the screws 116 forwardly to at least partially behind the plastic retaining strip 113. The lesser side wall 192 is shown as extending from the heads 117 of the screws 116 forwardly to above the plastic strip 113. The side walls 191 and 192 define the channelway 188 with a cross-section conforming closely to that of the screwstrip 114 and its strip 113 and screws 116 with an enlarged width where the heads of the screws are located and an enlarged width where the retaining strip 113 is provided about the screws. The side walls 191 and 192 also have a enlarged funnelling section at the entranceway opening 190 which tapers inwardly to assist in guiding the screw strip to enter the channelway.

As best seen in FIG. 9, the major side wall 191 is provided on its exterior back surface with a raceway 194 extending parallel the channelway 188 and in which a shuttle 196 is captured to be slidable towards and away from the guide tube 175 between an advanced position near the guide tube and a withdrawn position remote from the guide tube. The shuttle 196 has a rear surface 197 in which there is provided a rearwardly directed opening 198 adapted to receive the front end 156 of the forward arm 154 of lever 148 so as to couple the shuttle 196 to the lever 148 for movement therewith.

Figure 12:
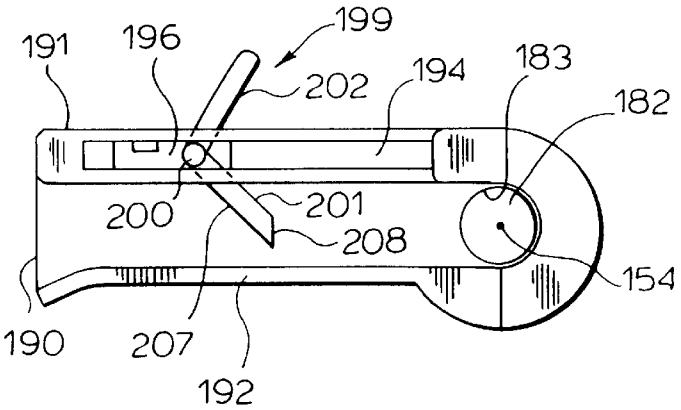
FIG. 12 is an end view of the nose position of FIG. 8.

Shuttle 196 carries a pawl 199 to engage the screwstrip 114 and with movement of the shuttle 196 to successively advance the strip one screw at a time. As seen in FIG. 12, the shuttle 196 has a fixed post 200 on which the pawl 199 is journalled about an axis parallel the longitudinal axis 152 about which the driver shaft 34 rotates. The pawl 199 has a strip pusher arm 201 which extends through a slot 203 in the major side wall 191 to engage and advance the screwstrip. The pawl 199 has a manual release arm 202 away from pusher arm 201 and which extends out through a slot 204 in the shuttle 199. A torsional spring is disposed about post 200 between pawl 199 and shuttle 196 and urges the pusher arm 201 clockwise as seen in FIG. 12. The spring biases the pusher arm 201 into the screwstrip 114. The engagement of release arm 202 on the right hand end of slot 204 limits the pivoting of the pawl 199 clockwise to the position shown in FIG. 12.

The pusher arm 201 of the pawl 199 has a cam face 207. On the shuttle moving away from the guide tube 175 towards the withdrawn position, i.e., to the left in FIG. 12, the cam face 207 will engage the screws 116 and/or the strip 113 and permit the pusher arm 201 to pivot about post 200 against the bias of spring so that the pusher arm 201 may move with the shuttle to the left.

The pusher arm 201 has an engagement face 208 to engage the screws 116 and/or strip 113. On the shuttle moving towards the guide tube 175 towards the advanced position, i.e., to the right in FIG. 12, the engagement face 208 will engage the screws 116 and/or strip 113 and advance the screwstrip to the right as seen in FIG. 12 so as to position a screw 116 into the guideway 182 in a position to be driven and to hold the screwstrip 114 against movement towards the left.

The release arm 202 permits manual withdrawal of the screwstrip 114. A user may, with his finger or thumb, manually pivot the release arm 202 against the bias of spring so that the pusher arm 201 and its engagement face 208 is moved away from and clear of the screwstrip 114 whereby the screwstrip may manually be withdrawn as may be useful to clear jams or change screwstrips.

With the nose portion 124 coupled to the rear portion 122, the lever 148 couples to the shuttle 196 with the forward arm 154 of lever 148 received in the opening 198 of the shuttle 196. Sliding of the slide body 120 and the housing 118 in a cycle from an extended position to a retracted position and then back to an extended position results in reciprocal pivoting of the lever 148 about axis 151 which slides the shuttle 196 between the advanced and withdrawn position in its raceway 194 and hence results in the pawl 199 first retracting from engagement with a first screw to be driven to behind the next screw 116 and then advancing this next screw into a position to be driven.

The nose portion 124 is removable from the rear portion 122. The nose portion 124 and rear portion 122 may be coupled together by axially inserting the cylindrical portion 77 of the guide tube 175 into the bore 178 in the rear portion 122 with the key 180 aligned with the keyway slot 182 and with the front end 156 of the forward arm 154 of the lever 148 aligned with the opening 198 in the shuttle 196. Thus, the removable nose portion 124 may be coupled to the rear portion 122 merely by axially aligning the nose portion and the rear portion and moving the two elements together in a direction parallel the longitudinal axis 152.

With the nose portion 124 held on the rear portion 122 by a friction fit, the nose portion 124 can manually be removed by a user merely by the manual application of force. The nose portion 124 is removable from the rear portion 122 without disassembly or uncoupling of any of the remainder of the screwdriver assembly 110. Thus, the nose portion 124 is removable without uncoupling of the rear portion 122 relative any of the housing 118, spring 138, drill 10, driver shaft 134 or the screw feed activation mechanism comprising, amongst other things, the lever 148 and cam follower 162 and without uncoupling of the cam follower 162 in camming channel 170 of the housing 118.

The nose portion 124 carries the guide tube 175 with its screw locating guideway 182, the screw feed channel element 176 with its channelway 188, and screw feed advance mechanism with the reciprocating shuttle 196 and pawl 199 to advance the screwstrip 114 via the channelway 188 into the guideway 182. Each of the guideway 182, channelway 88 and shuttle 196 are preferably customized for screwstrips and screws or other fasteners of a corresponding size. In this context, size includes shape, head diameter, shaft diameter, retaining strip configuration, length, spacing of screws along the retaining strip and the presence or absence of washers, amongst other things. Different nose portions 124 are to be configured for different screwstrips and screws. The different nose portions 124 are each compatible with the same rear portion 122 and are readily exchangeable so as to permit the driver attachment to be readily adapted to drive different screwstrips and screws.

Many changes can be made to the physical arrangement of the nose portion 124 to accommodate different screws and fasteners. For example, the cross-sectional shape of the channelway 188 can be changed as can the diameter of the guideway 182. The length of the side walls 191 and 192 about the channelway 188 can be varied to accommodate different size screws which may require greater or lesser engagement.

To adjust for different spacing between screws in different screwstrips, the stroke of the shuttle 196 in reciprocating back and forth can be shortened or lengthened by varying the distance from the axis 151 of the lever 148 to where the shuttle 196 engages the forward arm 154 of the lever 148. For example, placing the same shuttle 196 in a raceway 194 spaced further from the axis 151 will increase the length of the stroke of the shuttle 196 for the same arc of pivoting of lever 148. Similarly, using the same shuttle 196 in the same raceway 194 but having the opening 198 in the shuttle 196 to engage the lever 148 farther from the axis 151 will also increase the length of the stroke of the shuttle 196 for the same arc of pivoting of lever 148.

In contrast with the removable nose portion 124 which is intended to be provided in many different replaceable configurations, the remainder of the driver attachment is preferably of a constant unchanged configuration. In this regard, the remainder of the driver attachment may be characterized by the housing 118, rear portion 122 of the slide body 120, drive shaft 134 and spring 138 together with a screw feed activation mechanism comprising the lever 148 and cam follower 162 interacting between the rear portion 122 and the housing 118. This screw feed activation mechanism is activated by relative movement of the housing 118 and rear portion 122 and serves to engage and move the screw feed advance mechanism comprising the shuttle 196 and pawl 199 carried on the nose portion 124.

The construction of the housing 118 and slide body 120 provide for a compact driver attachment.

The housing 118 has a part cylindrical portion formed by side wall 401.

The slide body 120, as been seen in FIG. 9, comprising the rear portion 122 and nose portion 124, has a part cylindrical portion of a uniform radius sized to be marginally smaller than the side wall 401 of the housing 118. The side wall 401 extends circumferentially about the part cylindrical portion of the slide body 120 to retain the slide body 120 therein.

The housing has a flange portion 402 which extends radially from one side of the part cylindrical portion and is adapted to house the radially extending flange 146 of the rear portion 122 and the screw feed activation mechanism comprising the camming channel 170 interacting with the lever 148 and cam follower 162. The flange portion 402 is open at its front end and side to permit the screw feed channel element 176 to slide into and out of the housing 118. Concentrically located about the drive shaft 134 is the spring 138, the part cylindrical portions of the slide body 120, and the part cylindrical portions of the housing 118.

The driver attachment is provided with an adjustable depth stop mechanism which can be used to adjust the fully retracted position, that is, the extent to which the slide body 120 may slide into the housing 118. The adjustable depth stop mechanism is best seen in FIGS. 8 and 9 as comprising an elongate rod 210 slidably received in an elongate open ended bore 211 provided in the side wall 142 of the housing 118 and extending parallel to longitudinal axis 152.

A depth setting cam member 214 is secured to the housing 118 for rotation about a pin 216 parallel the longitudinal axis 152. The cam member 214 has a cam surface 215 which varies in depth, parallel the longitudinal axis 152, circumferentially about the cam member 214. A portion of the cam surface 215 is always axially in line with the rod 210. A spring 212 biases the rod 210 rearwardly such that the rear end 217 of the rod engages the cam surface 215. The spring 212 is disposed between the housing and a pin 213 on the rod. By rotation of the cam member 214, the extent to which the rod 210 may slide rearwardly is adjusted.

The rod 210 has a front end 218 which extends forwardly from bore 211 for engagement with a rearwardly directed annular stop surface 219 provided on the nose portion 124 of the slide body. The slide body 120 is prevented from further sliding into the housing 118 when the front end 218 of the rod 210 engages the stop surface 219. The extent the slide body 120 may slide into the housing 118 is determined by the length of the rod 210 and the depth of the cam member 214 axially in line with the rod. The cam member 214 is preferably provided with a ratchet-like arrangement to have the cam member 214 remain at any selected position biased against movement from the selected position and with circular indents or depressions in the cam surface 215 to assist in positive engagement by the rear end 217 of the rod. The cam member 214 is accessible by a user, yet is provided to be out of the way and not interfere with use of the driver attachment. The nose portion 124 may be customized for use in respect of different size screws by having the location of the stop surface 219 suitably provided axially on the nose portion 124 as may be advantageous for use of different size screws.

The driver shaft 134 is shown in FIGS. 10 and 11 as carrying a split washer 220 engaged in an annular groove near its rear end 221 to assist in retaining the rear end of the driver shaft in the socket 127 of the housing 118. The driver shaft 134 is provided with a removable bit 222 at its forward end which bit can readily be removed for replacement by another bit as for different size screws. Such bits include sockets and the like and any replacement bits will preferably be of an outside diameter complementary to the inside diameter of the guideway 182 in a corresponding replacement nose portion adapted for use with the corresponding sized screws. To accommodate bits of increased diameter over the bit shown in FIGS. 10 and 11, the guideway 182 of the guide tube 175 may be provided with an increased radius, at least commencing at the location where the bit may have an enlarged diameter and extending forwardly therefrom. The guideway 182 in the guide tubes 175 may thus have a step configuration with the side wall 183 being of a reduced diameter where the driver shaft 134 enters the rear of the guide tube 175 and the side wall 183 may then increase to an enlarged diameter forwardly to accommodate an enlarged bit such as a socket.

The rear portion 122 is shown in FIGS. 10 and 11 as having a radially inwardly extending annular flange 119 which provides the end of the forwardly opening bore 178 as well as the end of a rearwardly opening bore 179 within which the spring 138 is received. The annular flange 119 has an opening therethrough of a diameter slightly larger than the diameter of the driver shaft 134 so as to assist in journalling the driver shaft therein. The opening through the annular flange 119 may, however, be increased so as to facilitate the use of driver shafts 134 having enlarged diameters as well as driver shafts 134 having reduced diameters.

Insofar as the driver shaft 134 has a removable bit 222, it is preferred that, as shown, when the driver attachment 112 is in the fully extended position and the nose portion 124 is removed, the bit 222 be readily accessible for removal and replacement. In this regard, it is preferred that the nose portion 224 have a guideway 182 of a minimum diameter throughout its length at least equal to the diameter of the bit 222 such that the nose portion 124 may be removed from the rear portion 222 without the need to remove the bit 222 as may otherwise be the case in the event the guideway 182 may have a stepped configuration.

Operation of the driver attachment is now explained with particular reference to FIGS. 10 and 11. As seen in FIG. 10, the screws 116 to be driven are collated to be held parallel and spaced from each other by the plastic retaining strip 113.

In operation, a screwstrip 114 containing a number of screws 116 collated in the plastic retaining strip 113 is inserted into the channelway 188 with the first screw to be driven received within the guideway 182. To drive the first screw into the workpiece 224, the power driver 10 is activated to rotate the driver shaft 134. The driver shaft 134 and its bit 222, while they are rotated, are reciprocally movable in the guideway 182 towards and away from the workpiece 224. In a driving stroke, manual pressure of the user pushes the housing 118 towards the workpiece 224. With initial manual pressure, the forward end 125 of the nose portion engages the workpiece 224 to compress spring 138 so as to move slide body 120 relative the housing 118 into the housing 118 from an extended position shown in FIG. 10 to a retracted position. On release of this manual pressure, in a return stroke, the compressed spring 138 moves the slide body 120 back to the extended position thereby moving the housing 118 and the driver shaft 134 away from the workpiece.

In a driving stroke, as the driver shaft 134 is axially moved towards the workpiece, the bit 222 engages the screw head 117 to rotate the first screw to be driven. As is known, the plastic strip 113 is formed to release the screw 116 as the screw 116 advances forwardly rotated by the driver shaft 134. Preferably, on release of the screw 116, the plastic strip 113 deflects away from the screw 116 outwardly so as to not interfere with the screw 116 in its movement into the workpiece. After the screw 116 is driven into the workpiece 224, the driver shaft 134 axially moves away from the workpiece under the force of the spring 138 and a successive screw 116 is moved via the screw feed advance mechanism from the channelway 188 through the access opening 186 into the guideway 182 and into axial alignment in the guideway with the driver shaft 134.

The screw 116 to be driven is held in position in axial alignment with the driver shaft 134 with its screw head 117 abutting the side wall 183 in the guideway 182. As a screw 116 to be driven is moved into the cylindrical guideway 182, a leading portion of the strip 113' from which screws have previously been driven extends outwardly from the guidway 183 through the exit opening 187 permitting substantially unhindered advance of the screwstrip 114.

To assist in location of a screw to be driven within the guide tube 175, in the preferred embodiment the exit opening 187 is provided with a rearwardly facing locating surface 225 adapted to engage and support a forward surface 222 of the strip 113. Thus, on the bit 222 engaging the head of the screw and urging the screw forwardly, the screw may be axially located within the guide tube 175 by reason no only of the head of the screw engaging the side wall 183 of the guideway but also with the forward surface 322 of the strip 113 engaging the locating surface 225 of the exit opening 187. In this regard, it is advantageous that the forward surface 322 of the retaining strip 113 be accurately formed having regard to the relative location of the screws 116 and, particularly, the location of their heads 117. The forward surface 322 of the strip 113 may be complementary formed to the locating surface 225 and, if desired, indexing notches or the like may be provided in the forward surface 322 of the strip 113 to engage with complementary notches or indents on the locating surface 225 of the entranceway to assist in indexing location of the strip 113 relative the locating surface and enhance the location thereby of the screw 116 within the guide tube 175.

A preferred collated screwstrip 114 for use in accordance with the present invention is as illustrated in the drawings and, particularly, FIG. 9 and are substantially in accordance with Canadian Patent 1,054,982. The screwstrip 114 comprises a retaining strip 113 and a plurality of screws 116. The retaining strip 113 comprises an elongate thin band formed of a plurality of identical sleeves interconnected by lands 206. A screw 116 is received within each sleeve. Each screw 116 has a head 117, a shank 308 carrying external threads 314 and a tip 115. As shown, the external threads extend from below the head 117 to the tip 115.

Each screw is substantially symmetrical about a central longitudinal axis 312. The head 117 has in its top surface a recess 313 for engagement by the screwdriver bit.

Each screw is received with its threaded shank 308 engaged within a sleeve. In forming the sleeves about the screw as in the manner, for example, described in Canadian Patent 1,040,600, the exterior surfaces of the sleeves come to be formed with complementary threaded portions which engage the external thread 314 of the screw 116. Each sleeve has a reduced protion between the lands 306 on one first side of the strip 113. This reduced strength portion is shown where the strip extends about each screw merely as a thin strap-like portion or strap 320.

The strip 113 holds the screw 116 in parallel spaced relation a uniform distance apart. The strip 113 has a forward surface 322 and a rear surface 323. The lands 206 extend both between adjacent screws 116, that is, horizontally as seen in FIG. 9, and axially of the screws 116, that is, in the direction of the longitudinal axes 312 of the screws. Thus, the lands comprise webs of plastic material provided over an area extending between sleeves holding the screws and between the forward surface 322 and the rear surface 323. A land 306 effectively is disposed about a plane which is parallel to a plane in which the axes 312 of all the screws lies. Thus, the lands 306 comprise a web which is disposed substantially vertically compared to the vertically oriented screws as shown in the figures. The lands 306 and the sleeves, in effect, are disposed as a continuous, vertically disposed strip 113 along the rear of the screws 116, that is, as a strip 113 which is substantially disposed about a plane which is parallel to a plane containing the axes of all screws.

A preferred feature of the screwstrip 114 is that it may bend to assume a coil-like configuration due to flexibility of the lands 306 such that, for example, the screwstrip could be disposed with the heads of the screws disposed into a helical coil, that is, the plane in which all the axes 312 of the screws lie may assume a coiled, helical configuration to closely pack the screws for use. Having the lands 306 and sleeves as a vertically extending web lying in the plane parallel that in which the axes 312 permits such coiling.

The invention is not limited to use of the collated screwstrips illustrated. Many other forms of screwstrips may be used such as those illustrated in U.S. Pat. Nos. 3,910,324 to Nasiatka; 5,083,483 to Takagi; 4,019,631 to Leidegard et al and 4,018,254 to Decarlo.

The present invention has been described with reference to preferred embodiments. Many modifications and variations will now occur to persons skilled in the art. For a definition of the invention, reference is made to the appended claims

I claim:

1. A coupling mechanism for selective connection to a power tool of the type having a rotatable chuck and a non-rotatable housing, the mechanism comprising:

an elongated mandrel having a longitudinal axis and an end adapted to be secured in the chuck for rotation therewith;

a thrust bearing carried on said mandrel;

a collar member having a length measured in a direction generally parallel to said longitudinal axis being adapted to surround the chuck and comprising first and second sections, said first and second sections being coupled together for selective relative movement to adjust the length of said collar member, one of said first and second sections engaging said thrust bearing and the other of said first and second sections adapted for engagement with the power tool housing whereby by adjustment of the length of said collar member, said collar member may be sandwiched between the power tool housing and said thrust bearing to frictionally secure said collar member against movement relative to the power tool housing and to permit relative rotational movement between said collar member and said mandrel.

2. A mechanism as claimed in claim 1 wherein the thrust bearing engages said collar member to locate said collar member coaxially relative said mandrel.

3. A mechanism as claimed in claim 1 for use with a power tool in which the chuck is carried on a rotatable shaft wherein said collar member is disposed coaxially about the axis of the shaft.

4. A mechanism as claimed in claim 3 wherein said thrust bearing engages said collar member to locate said collar member coaxially about the shaft.

5. A mechanism as claimed in claim 1 wherein said thrust bearing is received in said collar member and in engagement with surfaces of said collar member to locate said collar member coaxially about the shaft and, when connected to the power tool, to prevent said collar member from movement away from the power tool in the direction of said longitudinal axis.

6. A mechanism as claimed in claim 1 wherein said mandrel includes a rear end connected with the chuck and a forward end extending forwardly beyond said collar member and carrying a bit or socket for engagement with a threaded fastener.

7. A mechanism as claimed in claim 1 wherein said collar member carries extension coupling means adapted to removably secure a housing extension to said collar member against relative movement.

8. A mechanism as claimed in claim 1 wherein said mandrel includes a rear end adapted for connection to the chuck and an opposite forward end, said mechanism further including a driver attachment which receives screws collated together in spaced parallel relationship in a screwstrip for successive driving of the screws by a screwdriver bit carried on said forward end of said mandrel, the driver attachment including a housing extension secured by the coupling mechanism to the housing against movement relative the housing and, a slide member slideably received on the housing extension for reciprocal movement relative thereto parallel the axis of the shaft to successively advance screws on the screwstrip into axial alignment with the shaft and to drive the screws with the bit.

9. A mechanism as claimed in claim 8 wherein the coupling mechanism and driver attachment are separate elements and the coupling mechanism includes extension coupling means adapted to releasably couple the housing extension to said collar member against relative rotation.

10. A mechanism as claimed in claim 9 wherein the coupling means includes cylindrical engagement surfaces at a forward end of said collar member coaxially about the axis of the shaft and upon which a complementary socket member of the housing extension is releasably clamped to secure the driver attachment to the coupling mechanism.

11. A mechanism as claimed in claim 1 wherein the housing is engaged by said collar member at locations located at a radius about the axis of the shaft greater than a maximum radius of the chuck.

12. A mechanism as claimed in claim 1 wherein said mandrel includes a friction clutch mechanism operative between its ends.

13. A mechanism as claimed in claim 1 wherein said mandrel carries a stop member to engage said thrust bearing and prevent movement of the thrust bearing forwardly relative to said mandrel.

14. A mechanism as claimed in claim 13 wherein said stop member comprises a rearwardly directed shoulder on said mandrel to engage a forwardly directed shoulder on said thrust bearing.

15. A mechanism as claimed in claim 1 wherein said first and second sections comprise inner and outer telescoping cylindrical sections.

16. A mechanism as claimed in claim 15 wherein said first and second sections are threadably coupled together.

17. A mechanism as claimed in claim 1 wherein said collar member is a sleeve member.

18. A mechanism as claimed in claim 17 wherein said sleeve member has a central cylindrical cavity.

* * * * *

UNITED STATES PATENT AND TRADEMARK OFFICE

CERTIFICATE OF CORRECTION

PATENT NO. : 6,109,145
DATED : August 29, 2000
INVENTOR(S) : G. Lyle Habermehl

It is certified that error appears in the above-identified patent and that said Letters Patent is hereby corrected as shown below:

Title page, item [56],
References Cited reads "1,024,151 4/1912 Smith" should be -- 1,924,151 4/1912 Smith --

Column 1,
Related Applications reads "This application is a continuation of, and claims priority to, U.S. patent application Ser. No. 08/579,284, filed Dec. 27, 1995 now U.S. Pat. No. 5,662,011." should be deleted

UNITED STATES PATENT AND TRADEMARK OFFICE

CERTIFICATE OF CORRECTION

PATENT NO. : 6,109,145
DATED : August 29, 2000
INVENTOR(S) : G.Lyle Habermehl

It is certified that error appears in the above-identified patent and that said Letters Patent is hereby corrected as shown below:

Column 1,
Lines 34-44 reads,
"Such driver attachments are known to be relatively, easily be coupled to screw guns which have an extension of the housing comprising a cylindrical surface disposed coaxially about the rotating shaft of the screw gun and onto which the driver attachment can be clamped. Of course, this requires complementary sizing of the cylindrical extension of the housing and a clamp mechanism provided as part of the driver attachment. Other complementary attachment systems can be provided and are known including those in which the driver attachment is adapted for threaded engagement onto a threaded cylindrical extension of the housing."

should read,
-- Screw guns are known which have an extension of the housing comprising a cylindrical surface disposed coaxially about the rotating shaft of the screw gun and onto which attachments can be clamped. These attachments can include the driver attachments referred to above and the mandrel extension attachment taught by DE-A-43 25 995. Of course, this requires complementary sizing of the cylindrical extension of the housing and a clamp mechanism provided as part of the attachment. Other complementary attachment systems can be provided and are known including those in which the attachment is adapted for threaded engagment onto a threaded cylindrical extension of the housing. --

Signed and Sealed this

Sixteenth Day of October, 2001

*Attest:*

Nicholas P. Godici

*Attesting Officer*

NICHOLAS P. GODICI
*Acting Director of the United States Patent and Trademark Office*